United States Patent [19]

Bernard et al.

[11] 4,100,528

[45] Jul. 11, 1978

[54] MEASURING-WHILE-DRILLING METHOD AND SYSTEM HAVING A DIGITAL MOTOR CONTROL

[75] Inventors: James I. Bernard, Houston; Gerald A. Strom, Dayton, both of Tex.

[73] Assignee: Schlumberger Technology Corporation, New York, N.Y.

[21] Appl. No.: 727,686

[22] Filed: Sep. 29, 1976

[51] Int. Cl.[2] ..... G01V 1/40

[52] U.S. Cl. ..... 340/18 LD; 318/314; 318/318; 340/18 NC

[58] Field of Search ..... 340/18 NC, 18 LD; 318/312, 314, 318; 175/50

[56] References Cited

U.S. PATENT DOCUMENTS

| | | | |
|---|---|---|---|
| 3,176,208 | 3/1965 | Gifft | 318/314 |
| 3,331,006 | 7/1967 | Strand et al. | 318/318 |
| 3,789,355 | 1/1974 | Patton | 340/18 LD |
| 3,820,063 | 6/1974 | Sexton et al. | 340/18 LD |
| 3,828,234 | 8/1974 | Goldberg | 318/314 |
| 3,950,682 | 4/1976 | Dohanich, Jr. | 318/314 |
| 3,974,428 | 8/1976 | Hafle | 318/314 |

*Primary Examiner*—Howard A. Birmiel

*Attorney, Agent, or Firm*—David L. Moseley; William R. Sherman; Stewart F. Moore

[57] ABSTRACT

A measuring-while-drilling system has a digitally implemented motor speed control circuit for controlling a downhole, motor-driven acoustic signal generator. The acoustic generator is motor driven at speeds for imparting to well fluid an acoustic signal having phase states representative of encoded data derived from measured downhole conditions. The digital motor control circuit drives the motor at a substantially constant, carrier frequency producing speed in the absence of data of one logic state and temporarily changes the speed of the motor to effect a predetermined phase change in the carrier signal upon data of the predetermined logic state. For returning the motor speed to the carrier frequency producing speed during phase changes, the digital motor control circuit includes a first digital integrating circuit for providing a first digital signal having a value indicative of the constant value of the carrier frequency integrated over a time period beginning substantially upon the occurrence of the particular data; it has a second digital integrating circuit for providing a second digital signal having a value indicative of the instantaneous speed of the acoustic generator integrated over the time period; and it has a digital comparator which is responsive to the first and second digital signals for generating a control signal effective to change the speed of the motor when the difference between the first and second digital signals reaches a predetermined value.

22 Claims, 4 Drawing Figures

MEASURING-WHILE-DRILLING METHOD AND SYSTEM HAVING A DIGITAL MOTOR CONTROL

CROSS REFERENCE TO RTELATED APPLICATIONS

This application is related to co-pending applications Ser. Nos. 727,685 and 727,686, filed of even date herewith.

BACKGROUND OF THE INVENTION

This invention relates to data measuring of downhole conditions within wells during drilling and more particularly relates to apparatus and methods for telemetering data in such operations using an acoustic signal transmitted through the drilling fluid during drilling.

Various logging-while-drilling techniques for telemetering data representing downhole conditions during drilling of a well have been suggested. One approach uses a technique which imparts an acoustic signal, modulated according to the sensed conditions, to the drilling fluid, i.e., the drilling mud, for transmission to the entrance of the well where it is received and decoded by uphole electronics circuitry. This basic technique is described in detail in U.S. Pat. No. 3,309,656, issued Mar. 4, 1967 to Godbey entitled "Logging-While-Drilling System." In this system the modulated signal is applied to the drilling fluid using an acoustic signal generator which includes a movable member for selectively interrupting the drilling fluid. At least part of the flow of the drilling fluid is through the acoustic generator, and the movable member selectively impedes this flow, transmitting a continuous acoustic wave uphole within the drilling fluid.

The acoustic signal is preferably phase shift keyed modulated, as disclosed in U.S. Pat. No. 3,789,355, issued Jan. 29, 1974, to Patton entitled "Method and Apparatus For Logging While Drilling." According to phase shift keyed (PSK) modulation, the data derived in response to the sensed downhole condition is initially encoded into binary format, and the acoustic signal generator is driven at speeds so that the phase of a carrier wave generated in the drilling fluid is indicative of the data. In particular, a non-return to zero type PSK mode is used wherein the phase of the carrier signal is changed only upon each receipt of data of a predetermined value. For example, for data encoded in binary, the phase of the carrier wave may be changed for each occurring of a logic 1 data bit.

Ideally the phase change of the carrier signal would be instantaneous upon occurrence of the data of the particular value. This is because the downhole telemetering unit is continuously transmitting data to the uphole receiving instruments where the data in turn is continuously decoded. Any delays in effecting the phase change and in returning the acoustic signal to its carrier frequency introduce errors and/or inefficiencies into the system.

As a practical matter, however, the phase of the acoustic signal cannot be changed instantaneously in response to data of the predetermined value. Inherent delays are introduced by the physics of the system. The motor control circuitry which operates the motor-driven acoustic generator is adjusted accordingly to effect optimum response of the generator. Past proposals, such as the above-referenced Godbey and Patton patent, and in U.S. Pat. No. 3,820,063, issued June 25, 1974, to Sexton et al. entitled "Logging While Drilling Encoder," have proposed an analog implementation of the motor control circuitry. Because the motor control circuitry operates at a relatively low frequency, the analog approach has resulted in a system which may operate at a less than optimum data encoding/decoding rate. Furthermore, such analog circuitry suffers from the inherent disadvantages of instability over wide ranges of temperature, resulting in a less than optimally dependable system. More specifically, normal temperatures encountered within a borehole during drilling varies from 25° C to greater than 175° C, causing inherent changes in the device characteristics of the analog circuitry.

Furthermore, the analog approach suffers due to the rugged environment encountered during drilling conditions. The extreme vibrations and shock received by the analog circuitry not only reduces its longevity but also tends to render the circuitry out of adjustment.

Still further, analog circuits are relatively expensive to manufacture and test.

SUMMARY OF THE INVENTION

The above noted and other shortcomings are overcome by the present invention by providing a measuring-while-drilling system which features a digitally implemented motor speed control circuit for the motor driven acoustic generator. The digital motor speed control circuitry is relatively temperature stable and dependable and withstands the ruggedness of the downhole environment during drilling. Furthermore, the use of a digital control circuit reduces manufacturing and testing expense.

According to the invention, a measuring-while-drilling system includes a motor which drives an acoustic generator that is disposed for selectively interrupting the well fluid. The generator is driven at speeds for imparting to the well fluid an acoustic signal having phase states representative of data derived from measured downhole conditions. The system further includes the featured digital motor control circuit for: (1) driving the motor at a substantially constant speed to effect a constant carrier frequency in the acoustic signal and (2) temporarily changing the speed of the motor and returning it to the constant, carrier frequency producing speed according to a preprogrammed function to effect a predetermined phase change, i.e., modulation, in the carrier frequency according to the downhole derived data.

For returning the speed of the motor to the carrier frequency producing speed, the digital motor control circuit includes a first digital integrating circuit for providing a first digital signal having a value indicative of the value of the constant carrier frequency integrated over an integrating time period beginning substantially upon the occurrence of one of the data signals. A second dgital integrating circuit is provided for generating a second digital signal having a value indicative of the value of the instantaneous speed of the generator integrated over the integrating time period. A control signal generating circuit is provided responsive to the first and second digital signals for generating a control signal which effects a motor speed change when the difference between the first and second digital signals reaches a predetermined value.

According to a preferred embodiment of the invention, a modulation is effected by changing the speed of the motor in a first direction until a prescribed partial amount of the predetermined phase change is achieved.

The speed of the motor is then changed in the opposite direction until the remainder of the predetermined phase change is achieved. For implementing this aspect of the invention, the first and second digital integrating circuits respectively comprise digital counters for generating the digital signals. At least one of these counters is programmable and has programming inputs coupled to set the state of the programmable counter to a value corresponding to the prescribed partial amount of the predetemined phase change. The first and second digital signals thus generated are communicated to a digital comparator which generates the control signal when the difference between the first and second digital signals reaches the predetermined value, thereby indicating that the prescribed amount of the predetermined phase change has been accumulated.

According to another aspect of the preferred embodiment, the digital motor control circuit is effective to initially decelerate the motor speed to a speed corresponding to less than carrier frequency at the beginning of each integrating time period and is effective in response to the control signal to accelerate the motor speed towards the speed corresponding to the carrier frequency to thereby accumulate the remainder of the predetermined phase change. To effect maximum acceleration of the motor, the motor speed control circuit includes a ramp signal generating circuit for generating a speed controlling ramp signal in response to the control signal.

In still another aspect of the preferrred embodiment, the digital motor control circuit is operated in coordination with an encoder to produce a phase shift keyed signal. The motor control circuit is responsive to binary formatted data and modulates the carrier signal in a non-return to zero mode. More particularly, upon data of a particular logic state, for example a logic 1 data state, the phase of the acoustic signal is changed regardless of the previous phase of the acoustic signal. Accordingly, for a string of N-logic zeros, there would be no phase changes, yet for a string of N-Logic 1's there would be N phase changes.

Accordingly, it is a general object of the present invention to provide a new and improved apparatus and method using digital motor control for telemetering downhole, well-drilling data during drilling.

BRIEF DESCRIPTION OF THE DRAWINGS

The above and other features and advantages of the present invention will becomes more apparent in view of the following description of a preferred embodiment when read in conjunction with the drawings, wherein.

DESCRIPTION OF A PREFERRED EMBODIMENT

Figure 1:
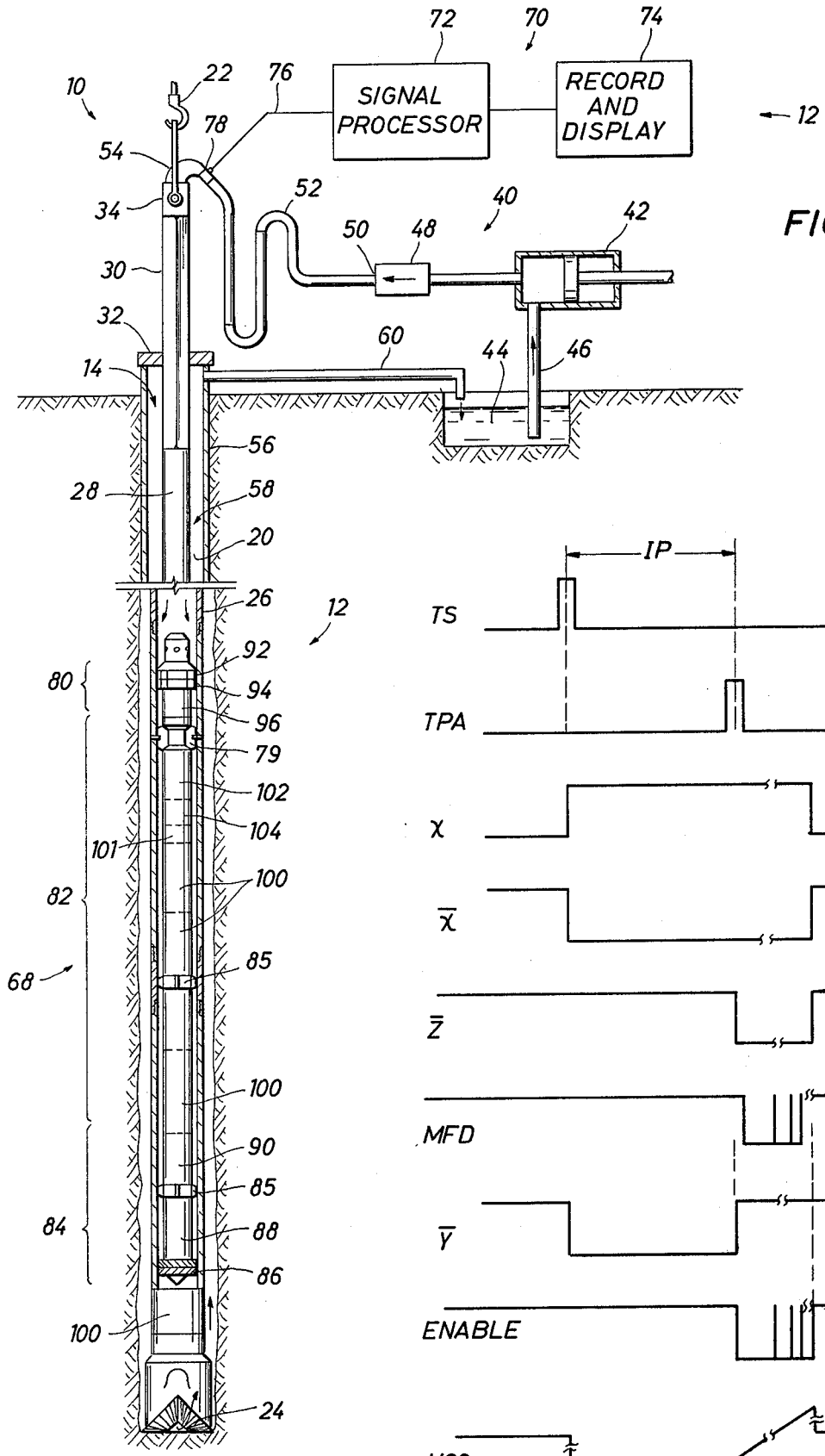
FIG. 1 is a schematic drawing showing a general well drilling and data measuring system according to the invention.

Referring now to the drawings, FIG. 1 shows a well drilling system 10 in association with a measuring-while-drilling system 12 embodying the invention. For convenience, FIG. 1 depicts a land based drilling system, but it is understood that a sea based system is also contemplated.

As the drilling system 10 drills a well-defining borehole 14, the measuring-while drilling system 12 senses downhole conditions within the well and generates an acoustic signal which is modulated according to data generated to represent the downhole conditions. The acoustic signal is imparted to drilling fluid, commonly referred to as drilling mud, in which the signal is communicated to the surface of the borehole 14. At or near the surface of the borehole 14 the acoustic signal is detected and processed to provide recordable data representative of the downhole conditions. This basic system is now well-known and is described in detail in the above referred U.S. Pat. No. 3,309,656 to Godbey which is hereby incorporated by reference.

The drilling system 10 is conventional and includes a drill string 20 and a supporting derrick (not shown) represented by a hook 22 which supports the drill string 20 within the hole 14.

The drill string 20 includes a bit 24, one or more drill collars 26, and a length of drill pipe 28 extending into the hole. The pipe 28 is coupled to a kelly 30 which extends through a rotary drive mechanism 32. Actuation of the rotary drive mechanism 32 (by equipment not shown) rotates the kelly 30 which in turn rotates the drill pipe 28 and the bit 24. The kelly 30 is supported by the hook via a swivel 34.

Positioned near the entrance to the borehole 14 is a conventional drilling fluid circulating system 40 which circulates drilling fluid, commonly referred to as mud, downwardly into the borehole 14. The mud is circulated downwardly through the drill pipe 28 during drilling, exits through jets in the bit 24 into the annulus and returns uphole where it is received by the system 40. The circulating system 40 includes a mud pump 42 coupled to receive the mud from a mud pit 44 via a length of tubing 46. A desurger 48 is coupled to the exit end of the mud pump 42 for removing any surges in the flow of the mud from the pump 42, thereby supplying a continuous flow of mud at its output orifice 50. A mud line 52 couples the output orifice 50 of the desurger to the kelly 30 via a gooseneck 54 coupled to the swivel 34.

Mud returning from downhole exits near the mouth of the hole 14 from an aperture in a casing 56 which provides a flow passage 58 between the walls of the hole 14 and the drill pipe 28. A mud return line 60 transfers the returning mud from the aperture in the casing 56 into the mud pit 44 for recirculation.

The measuring-while-drilling system 12 includes a downhole acoustic signal generating unit 68 and an uphole data receiving and decoding system 70. The acoustic signal generating unit 68 senses the downhole conditions and imparts a modulated acoustic signal to the drilling fluid. The acoustic signal is transmitted by the drilling fluid to the uphole receiving and decoding system 70 for processing and display.

To this end, the receiving and decoding system 70 includes a signal processor 72 and a record and display unit 74. The processor 72 is coupled by a line 76 and a pressure transducer 78 to the mud lines 52. The modulated acoustic signal transmitted uphole by the drilling fluid is monitored by the transducer 78, which in turn generates electrical signals to the processor 72. These electrical signals are decoded into meaningful information representative of the downhole conditions, and the decoded information is recorded and displayed by the unit 74.

One such uphole data receiving and decoding system 70 is described in U.S. Pat. No. 3,886,495 to Sexton et al., issued May 27, 1975, entitled "Uphole Receiver For Logging-While-Drilling System," which is hereby incorporated by reference.

The downhole acoustic signal generating unit 68 is supported within one of the downhole drill collars 26 by a suspension mechanism 79 and generally includes a modulator 80 having at least part of the flow of the mud passing through it. The modulator 80 is controllably driven for selectively interrupting the flow of the drilling fluid to thereby impart the acoustic signal to the mud. A cartridge 82 is provided for sensing the various downhole conditions and for driving the modulator 80 accordingly. The generating unit 68 also includes a power supply 84 for energizing the cartridge 82. A plurality of centralizers 85 are provided to position the modulator 80, the cartridge 82, and the supply 84 centrally within the collar 26.

The power supply 84 is now well-known in the art and includes a turbine 86 positioned within the flow of the drilling fluid to drive the rotor of an altenator 88. A voltage regulator 90 regulates the output voltage of the alternator 88 to a proper value for use by the cartridge 82.

The modulator 80 is also now well-known in the art. It includes a movable member in the form of a rotor 92 which is rotatably mounted on a stator 94. At least part of the flow of the mud passes through apertures in the rotor 92 and in the stator 94, and rotation of the rotor selectively interrupts flow of the drilling fluid when the apertures are in misalignment, thereby imparting the acoustic signal to the drilling fluid. The rotor 92 is coupled to gear reduction drive linkage 96 which drives the rotor. The cartridge 82 is operably connected to the linkage 96 for rotating the rotor 92 at speeds producing an acoustic signal in the drilling fluid having (1) a substantially constant carrier frequency which defines a reference phase value, and (2) a selectively produced phase shift relative to the reference phase value at the carrier frequency. The phase shift is indicative of encoded data values representing the measured downhole conditions.

In the preferred embodiment the drive linkage 96 and the designs of the rotor 92 and stator 94 are chosen to generate 1/5 of a carrier cycle in the acoustic signal for each revolution of the motor 102.

A suitable modulator 80 is shown and described in detail in U.S. Pat. No. 3,764,970 to Manning which is assigned to the assignee of this invention. Other suitable modulators 80 are described in the above-referenced Patton and Godbey patents, as well as in "Logging-While-Drilling Tool" by Patton et al., U.S. Pat. No 3,792,429, issued Feb. 12, 1974, and in "Logging-While-Drilling Tool" by Sexton et al., U.S. Pat. No. 3,770,006, issued Nov. 6, 1973, all of which are hereby incorporated by reference.

Referring now to the cartridge 82, it includes one or more sensors 100 and associated data encoding circuitry 101 for measuring the downhole conditions and generating encoded data signals representative thereof. For example, the sensors 100 may be provided for monitoring drilling parameters such as the direction of the hole (azimuth of hole deviation), weight on bit, torque, etc. The sensors 100 may be provided for monitoring safety parameters, such as for detecting over pressure zones (resistivity measurements) and fluid entry characteristics by measuring the temperature of the drilling mud within the annulus 58. Additionally, radiation sensors may be provided, such as gamma ray sensitive sensors for discriminating between shale and sand and for depth correlation.

The data encoding circuitry 101 is conventional and includes a multiplex arrangement for encoding the signals from the sensors into binary and then serially transmitting them over a data line. A suitable multiplex encoder arrangement is disclosed in detail in the above referenced Sexton et al. patent, U.S. Pat. No. 3,820,063, which is hereby incorporated by reference. The cartridge 82 also includes a motor 102 coupled to the linkage 96, and motor control circuitry 104 for controlling the speed of the motor 102 for rotating the rotor 92 of the modulator 80 at the proper speeds to effect the desired acoustic signal modulation. The motor 102 is a conventional two-phase AC induction motor which, in the preferred embodiment, is driven at 60 Hz by the motor control circuitry 102. Use of an induction motor for the motor 102 is not critical, as other types of motors, such as a d.c. servomotor, are suitable.

Figure 2:
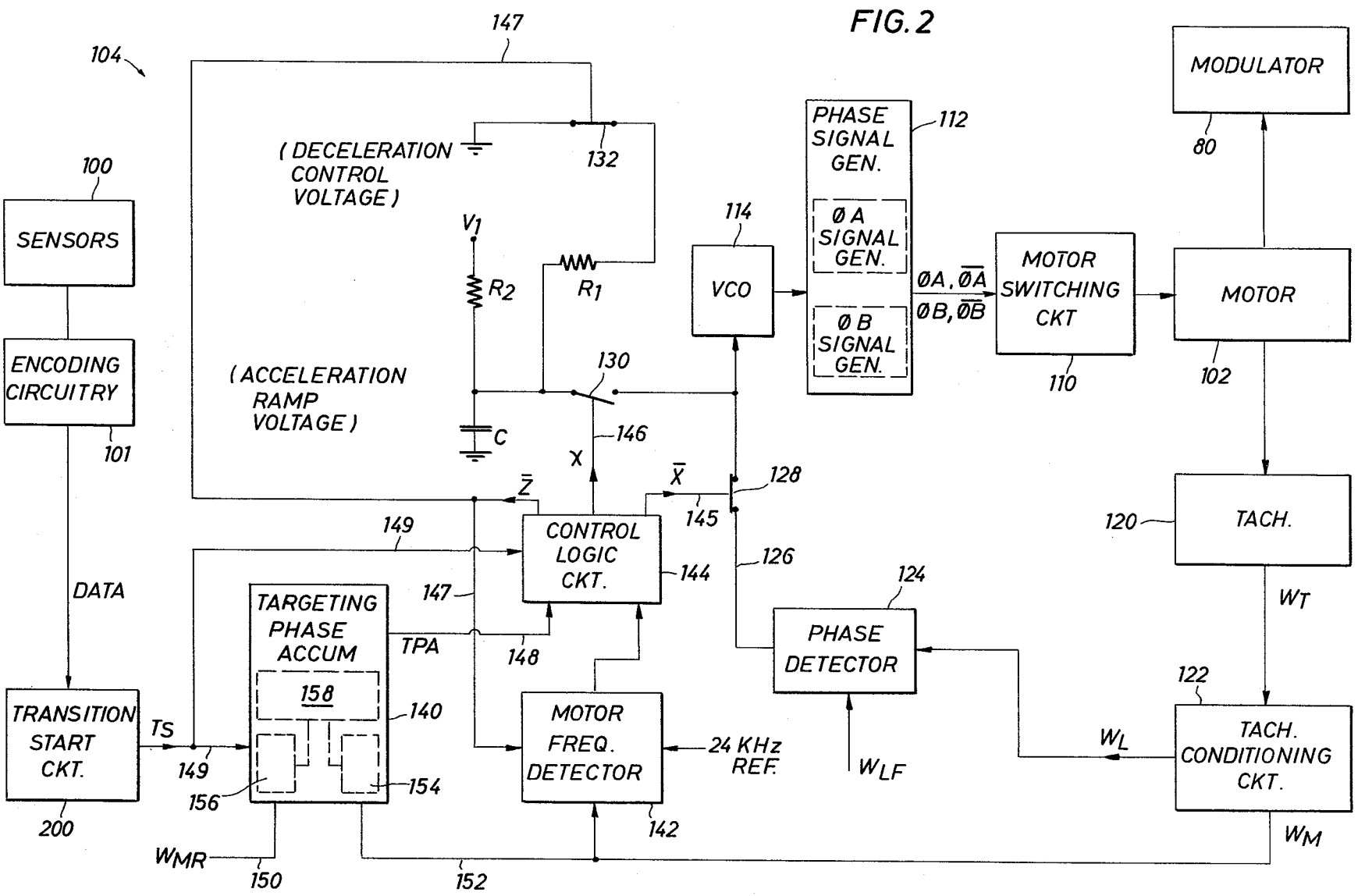
FIG. 2 is a block diagram of downhole telemetering apparatus utilized in the system of FIG. 1.

The motor control circuitry 104 is shown in relation to the motor 102, to the sensors 100 and encoding circuitry 101 and to the modulator 80 in FIG. 2. The motor control circuitry 104 includes circuitry (1) for maintaining the substantially constant carrier frequency of the acoustic signal transmitted in the drilling mud at the proper phase and (2) for changing the frequency of the acoustic signal and returning it to the carrier frequency to thereby change the phase thereof by a predetemined value as rapidly as possible in response to the encoded data. In the preferred embodiments wherein the data from the sensors 100 is encoded in binary, the phase change is one of 180°.

The motor control circuitry 104 includes a motor switching circuit 110, such as a conventional dc-ac inverter, for supplying two-phase power to the two-phase motor 102.

A phase signal generator 112 and a voltage controller oscillator (VCO) circuit 114 are provided to generate to the motor switching circuit 110 a pair of phase signals $\phi A$, $\phi B$ and their complements $\overline{\phi A}$, $\overline{\phi B}$. The phase signals are 90° out of phase from one another. The voltage control oscillator circuit 114 is conventional, and the phase signal generator 112 includes conventional circuitry for generating approximately 50 percent duty cycle wave forms and their complements. In the preferred embodiment the VCO circuit 114 operates at slightly higher than 240 Hertz during carrier frequency operation. This frequency accounts for inherent "slip" of the induction motor 102 and provides a frequency multiplication factor of four necessary for the phase signal generator 112 to provide the phase signals $\phi A$, $\phi B$ at the desired 60 Hertz frequency. For convenience of description, the slip of the motor will hereafter be assumed negligible.

In the preferred embodiment the circuitry for mantaining the carrier frequency and phase of the acoustic signal in the absence of selected data signals, in combination with the motor switching circuit 110, the phase signal generator 112, and the voltage controlled oscillator circuit 114, advantageously implements a phase locked loop circuit.

The phase and frequency maintaining circuitry includes a tachometer 120 coupled to the motor 102 for producing a series of pulses whose repetition rate is indicative of the frequency at which the motor 102 is driven. In the preferred embodiment the tachometer 120 is selected to generate six cycles per revolution of the motor. This ratio, in combination with the design of the modulator 80, the design of the drive linkage 96, and the 60 Hz speed of the motor 102, results in the generation of an acoustic signal within the drilling mud having a 12 Hz carrier frequency and in the generation of a tachometer output signal $\omega_T$ having a 360 Hz frequency.

A tachometer signal conditioning circuit 122 is coupled to the output of the tachometer 120 for providing a relatively low frequency loop frequency signal, $\omega_L$, and a relatively high frequency motor frequency signal $\omega_M$. For example, the loop frequency signal $\omega_L$ is produced at a 24 Hz frequency and the motor frequency signal $\omega_L$ is produced at a 720 Hz frequency when the motor is operating at 60 Hz. The conditioning circuit 122 is conventionally implemented using zero crossing circuitry and frequency multiplying/dividing circuitry.

The phase locked loop circuitry further includes a phase detector circuit 124. The phase detector circuit 124 is responsive to the loop frequency signal $\omega_L$, and to a 24 Hertz loop reference frequency signal $\omega_{LF}$ to selectively generate a VCO control signal on a line 126 which is operatively coupled to the VCO circuit 114 via a loop switch 128. The phase detector 124 is conventional and may include a set/reset flip-flop (not shown) responsive to the signals $\omega_L$, $\omega_{LF}$ and a low pass filter (not shown) coupled to the output of the flip-flop. The output of the detector 124 generates the VCO control signal as a function of the difference per loop cycle between the $\omega_L$ and $\omega_{LF}$ signals to be indicative of the motor 102 deviating from the constant carrier frequency or phase. In response to the control signal on the line 126, the VCO circuit 114 changes the excitation frequency supplied to the motor 102 via the inverter 110 to return the motor to and maintain it in phase and frequency lock.

The above referenced Sexton et al. patent, U.S. Pat. No. 3,820,063 shows and describes another phase locked loop circuitry operating on similar principles.

According to an outstanding feature of the invention, the circuitry for changing the speed of the motor 102 to thereby change the phase of the acoustic signal in response to data from the sensors 100 is implemented digitally. The digital implementation effects a frequency and phase change in the acoustic signal rapidly yet in an extremely accurate manner. The size of the package for the motor control circuitry has been reduced over that of previously proposed analog systems due to the digital implementation, and reliability over wide environmental ranges is achieved.

As will be described, the circuitry for changing the speed of the motor operates initially to decelerate the speed of the motor 102 and then to accelerate it for accumulating the total phase of change of 180°. Although an acceleration/deceleration sequence is operable, the deceleration/acceleration sequence results in the motor 102 operating in a higher torque range and thus in the modulating of the acoustic signal more predictably and in a shorter period of time.

The digitally implemented speed changing circuitry operates the switch 128 and a set of acceleration and deceleration switches 130, 132, which respectively control the voltage input to the VCO circuit 114. In the illustrated embodiment, the acceleration switch 130 has one terminal commonly connected to the input of the VCO circuit 114 and to one terminal of the loop swtich 128. It has its other terminal commonly coupled to a ramp voltage producing network and to the deceleration switch 132 via a resistor R1. The ramp voltage need not be limited to a linearally changing voltage. For example it may change substantially exponentially with time. As illustrated an RC timing circuit comprising the series connection of a resistor R2 and capacitor C between a voltage $V_1$ and circuit ground produces an exponentially increasing voltage. Accordingly, when the loop switch 128 is open, the acceleration switch 130 is in the closed position and the deceleration switch is opened, the input to the VCO circuit 114 is a ramp voltage, effecting an output from the VCO circuit 114 which increases with time amd thus effecting acceleration of the motor which is an increasing function with time. This assures that the phase change in the acoustic signal is accomplished as rapidly as possible.

The deceleration switch 132 has one terminal commonly connected to the resistor R1 and thus to the switch 130. It has its other terminal connected to circuit ground. When the acceleration switch 130 is closed and the deceleration switch 132 is in the closed position, the capacitor C, which had been discharged through the resistor R1 to circuit ground by closing of the switch 132, remains discharged. In the preferred embodiment upon closing of the switch 130, the discharged capacitor C produces a voltage level at the input of the VCO circuit 114 which causes the output of the VCO circuit 114 to step down to approximately 180 Hz from its otherwise constant carrier frequency producing output of approximately 240 Hz.

The digital implementation of the speed changing circuitry includes a targeting phase accumulator 140, a motor frequency detector 142 and a control logic circuit 144. In response to input signals from the targeting phase accumulator 140 and from the motor frequency detector 142, the control logic circuit 144 generates a set of control signals, $\overline{X}$, X, and $\overline{Z}$ on a set of lines 145, 146, 147 to the switches 128, 130, 132 respectively. These signals are generated in a sequence, appropriately initiated by data from the sensors 100, which: (1) initially opens the loop switch 128 to take control away from the phase lock loop; (2) closes the acceleration switch 130 (the deceleration switch 132 already having been closed) to cause a low voltage level to be supplied to the VCO circuit 114 to thereby cause rapid deceleration of the motor 102, and thus change the frequency of the acoustic signal to approximately 9 Hz; (3) to open the deceleration switch 132 while leaving closed the acceleration switch 130 to begin acceleration of the speed of the motor 102 back toward the carrier frequency producing speed; and, (4) thereafter to open the acceleration switch 130 and to close the loop switch 128 to return control of the motor 102 back to the phase lock loop when the carrier frequency producing speed has been achieved by the motor 102.

Figure 4:
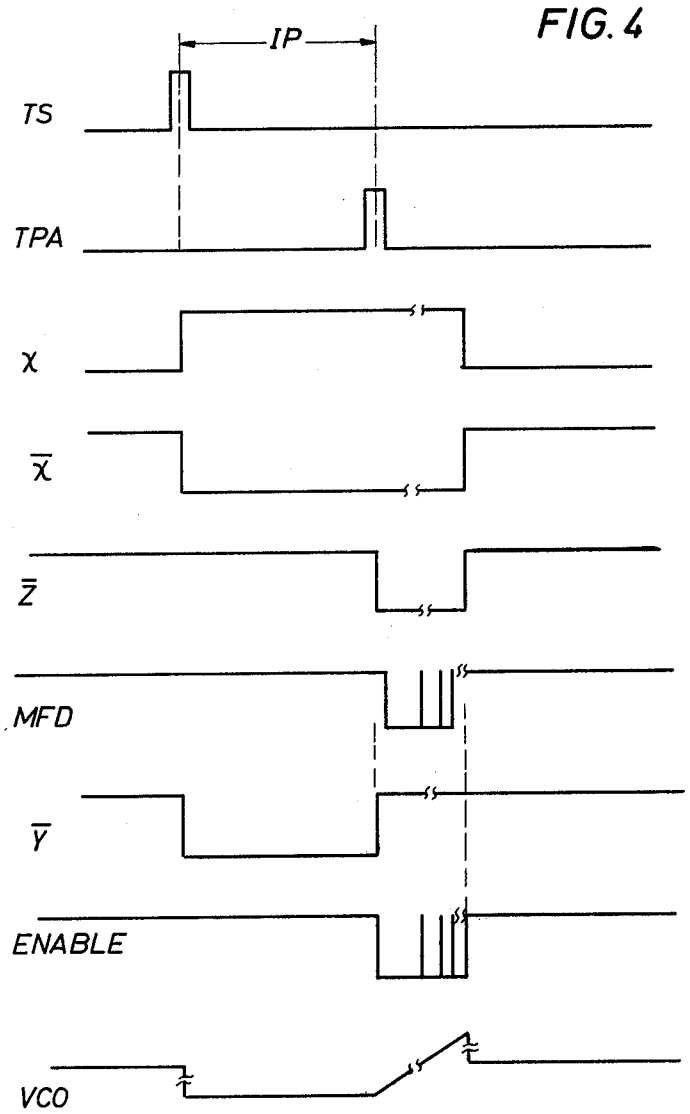
FIG. 4 is a set of exemplary waveforms illustrating operation of the downhole telemetering apparatus.

In more detail and referring to the waveforms depicted in FIG. 4, the targeting phase accumulator 140 generates a TPA control signal on the line 148 a period of time, referred to as the integrating period IP, corresponding to the accumulation of the predetermined amount of phase change, after a transition start (hereafter TS) timing signal has been generated on a line 149. At the beginning of one integrating period, IP, the logic control circuit 144 is generating the X, $\overline{X}$, and $\overline{Z}$ control signals to open the loop switch 128 and to close the acceleration switch 130 and to maintain closure of the deceleration switch 132, thereby causing deceleration of the motor 102. During this intergrating period, the targeting phase accumulator 140 effectively is integrating the difference between a 720 Hertz motor reference frequency signal, $\omega_{MR}$, on a line 150 and the motor frequency signal, $\omega_M$, on a line 152. In the illustrated embodiment, the signals $\omega_{MR}$ and $\omega_M$ are integrated. The difference between these integrated signals produces an indication of the amount of phase which is being accumulated due to speed changes of the motor 102. When the difference between the integrated values of the signals on the lines 150, 152 reaches a predetermined value due to the deceleration of the motor speed, the targeting phase accumulator 140 generates the TPA signal on the line 146, causing the control logic circuit 144 to open the switch 132. This permits the beginning of the rapid acceleration of the speed of the motor back toward the carrier frequency producing speed.

As above indicated for the illustrated embodiment, the motor reference frequency signal $\omega_{MR}$ on the line 150 is a 720 Hz signal. This results in sixty cycles of the motor reference frequency signal being produced for each cycle of the 12 Hz carrier frequency. Accordingly, thirty cycles of the $\omega_{MR}$ signal correspond to 180° of phase of the 12 Hz carrier.

Since a finite time is required to return the motor speed to the 60 Hz, carrier frequency producing speed, phase shift additional to that effected by the deceleration is accumulated during the return. With a typical load on the motor, it has been ascertained that approximately 65° of carrier phase change is accrued in the process of returning the speed of the motor 102 back from the 45 Hz frequency to the carrier frequency producing speed of 60 Hz. Accordingly, it is necessary to accumulate 115° of phase change in the targeting phase accumulator 140 prior to the generation of the TPA signal and thus of the beginning of the acceleration of the speed of the motor back towards 60 Hz. Since 30 cycles of the $\omega_{MR}$ signal correspond to 180° of carrier phase shift, the targeting phase accumulator 140 needs to accumulate $$115/180 \times 30 = 19 \text{ cycles or counts} \qquad \text{EQN. 1}$$

as the difference between the integrated $\omega_M$ and integrated $\omega_{MR}$ signals. The calculation in EQN. 1 is conditioned upon the characteristic linear relationship between phase loss and phase gain of the acoustic signal as a funtion of the changing of the motor frequency signal $\omega_M$.

The amount of additional phase accumulated due to return of the motor speed varies with motor loading. However, because the phase and frequency maintaining circuitry operates with inputs at twice the carrier frequency of 12 Hz, it acts to pull the motor speed into lock at 180° of phase change even when the phase changing circuitry results in a range of 91–269° of phase change.

In the preferred embodiment the targeting phase accumulator 140 includes a pair of digital accumulator circuits in the form of a motor frequency counter 154 and a tach reference frequency country 156. The motor frequency counter 154 is presettable to a value indicative of a desired amount of phase loss (i.e., the target value of 115°) due to the deceleration of the motor during the integrating period.

The targeting phase accumulator 140 also includes a digital comparator 158. The digital comparator 158 is coupled to the outputs of the counters 154, 156 and determines when the tach reference frequency counter 156 has been incremented by a value of 19 more than the motor frequency counter 154. Upon this condition, the comparator 158 generates the TPA signal to the motor control logic circuit 144, indicating that the target value of 115° of phase change has been accumulated.

Figure 3:
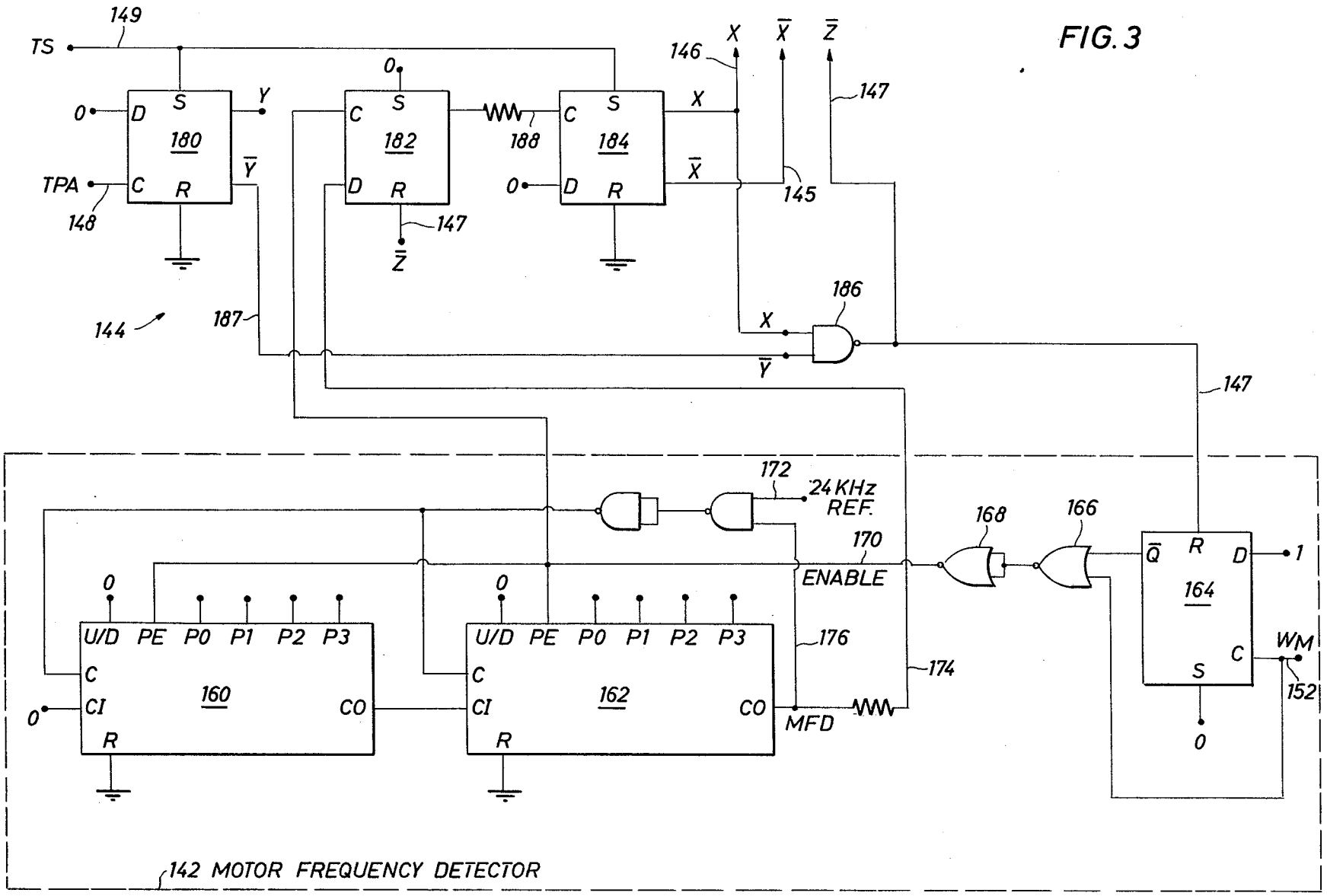
FIG. 3 is a circuit schematic of logic circuitry utilized within the downhole telemetering apparatus of FIG. 2.

The motor frequency detector 142 and the control logic circuit 144, as shown in detail in FIG. 3, effect acceleration of the speed of the motor 102 back to the 60 Hz carrier frequency producing speed. The detector 142 comprises a digital integrator which includes a pair of presentable counters 160, 162 which are coupled to the output of an R/S flip-flop 164. The flip-flop 164 has its clock input coupled to the line 152 for receiving the motor frequency signal $\omega_M$ and generating an ENABLE signal through a pair of gates 166, 168 to the counters 160, 162 via a line 170. the ENABLE signal on the line 170 is generated upon the absence of the Z control signal on the line 147 to the reset terminal of the flip-flop 164. The Z control signal on the line 147 is removed by the control logic circuit 144 upon generation of the TPA signal (at the end of the integration period IP) on the line 148 from the targeting phase accumulator 140.

Because the motor 102 has been decelerated to a speed less than 60 Hz at the time of the occurrence of the TPA signal, the period of the motor frequency signal $\omega_M$ is longer than normal. The purpose of the presettable counters 160, 162 is to determine when the period of the motor frequency signal $\omega_M$ is indicative that the speed of the motor has been accelerated back to 60 Hz after generation of the TPA signal. To this end, the counters 160, 162 have preset lines (not shown) which determine the number of counts the counters 160, 162 will achieve when the period of the $\omega_M$ signal is proper for 60 Hz operation. The counters 160, 162 are also responsive to a 24 KHz high frequency reference signal on a line 172 which provides a high frequency clocking signal to the counters for incrementing them. The counters 160, 162 are preset to the value which causes a MFD signal to be generated on a line 174 whenever the 24 KHz reference signal on the line 172 causes the number of counts accumulated by the counters 160, 162 to exceed the preset value. The period of the ENABLE signal on the line 170 is decreasing with time due to the acceleration of the motor. Eventually the MFD signal on the line 174 is not generated for a given period of the ENABLE signal. Upon this condition, the motor 102 is operating once again at the carrier frequency producing speed.

Operation of the motor frequency detector 142 is better understood when considering the control logic circuit 144 as shown in FIG. 3. The control logic circuit 144 includes three R/S flip-flops 180, 182, 184 and a NAND gate 186. The flip-flops 180, 184 respectively generate a $\overline{Y}$ signal on a line 187 and the X and $\overline{X}$ signals on the lines 146, 145. The gate 186 is coupled to the lines 146, 187 for generating the $\overline{Z}$ signal on the line 147 as a function of the X and $\overline{Y}$ signals.

The flip-flops 180, 184 are responsive to the TS timing signal on the line 149 and are set upon the occurrence of data of a predetermined logic state as sensed by the sensors 100. Setting of the flip-flop 184 causes a logic 1 and a logic 0 to be generated as the X and $\overline{X}$ signals, thereby closing and opening the acceleration and loop switches 130, 128 respectively. The flip-flop 180 generates a logic zero as the $\overline{Y}$ signal on the line 187 upon its being set by the TS signal. The $\overline{Y}$ signal is then coupled to the gate 186 for generating a logic one state of the $\overline{Z}$ signal. Upon the occurrence of the TPA signal, at the end of the integration period IP, the TPA signal on the line 148 clocks the flip-flop 180, changing the $\overline{Y}$ signal to a logic one. During this interval, the $\overline{Z}$ signal has maintained closed the deceleration switch 132 and has disabled operations of the flip-flop 182 by way of the reset input.

Recapitulating, upon generation of the TS timing signal and thus at the beginning of the integration period IP, the X, $\overline{X}$, and $\overline{Z}$ signals have respectively closed the switch 130, opened the switch 128, and maintained closure of the switch 132, causing deceleration of the motor 102.

At the end of the integration period when the targeting phase accumulator 140 has indicated that the desired 115 degrees of phase has been accumulated, as indicated by the TPA signal on the line 148, the flip-flop 180 changes state. This results as a logic 0 is applied to its data input and the TPS signal is applied to its clock input. This change of state generates a logic 1 as the Y signal on the line 187, causing a logic 0 to be generated on the line 147 as the Z signal. This opens the deceleration switch 132, ending the deceleration phase of the motor speed change and beginning the acceleration phase.

Referring now additionally to the motor frequency detector 142, as is also illustrated in detail in FIG. 3, when the $\overline{Z}$ signal on the line 147 changes to a logic 0, the flip-flops 164 and 182 become unlatched. A logic 1 applied to the data input of the flip-flop 164 is then clocked thereinto by the motor frequency signal $\omega_M$ producing a logic zero at one input of the gate 166. Another input of the gate 166 receives the $\omega_M$ signal on the line 152. The gates 166, 168 thereby generate the ENABLE signal on the line 170 to the counters 160, 162 for presetting them at the beginning of every cycle of the $\omega_M$ signal. The counters then begin counting at a 24 kHz rate, as determined by the 24 kHz signal on a line 172.

At the end of the ENABLE signal, i.e., at the end of one cycle of the motor frequency signal $\omega_M$, if a carry has occurred out of the counter 162, i.e., if a logic 0 has been generated on the line 174 as the MFD signal, the flip-flop 182 remains in the reset state (having been placed into the reset state by the $\overline{Z}$ signal on the line 147 upon the occurrence of the X signal going to the logic zero state indicating the end of the modulation). Only upon the condition that a logic 1 is provided on the line 174 to the flip-flop 182 when a logic 1 ENABLE signal occurs will a clock signal be provided via a line 188 to the flip-flop 184. Unless a clock signal is provided via the line 188, the flip-flop 184 maintains the X and X signals in the logic 1, logic 0 states as respectively set by the TS timing signals.

When the counters 160, 162 indicate that the period of the ENABLE signal, i.e., the period of one cycle of the motor frequency signal $\omega_M$ has been reduced to a value corresponding to a motor frequency of 60 Hz, no carry out of the counter 162 will occur. The logic 1 needed to change the state of the flip-flop 182 upon the next occurring ENABLE signal is thereupon generated. This provides a clock signal to and changes the state of the flip-flop 184, which in turn changes the states of the X and X signals, thereby closing the loop switch 128 and opening the acceleration switch 130. It is understood that, when viewing the MFD signal as depicted in FIG. 4 in connection with the above description, the value of the MFD signal is a logic 1 state during counting by the counters 160, 162. Because this time period is very small and the time scale of FIG. 4 is relatively large, these pulses appear as spikes. Also, the breaks in the MFD & ENABLE signals indicat that, when the motor 102 is back to full speed and the MFD signal remains in a logic 1 state due to no carry out from the counter 162, the ENABLE signal subsequently changes to a logic 1 state in which it remains until the next decoding stage.

The TS timing signal is produced is a conventional way by a transition start circuit 200. The transistion start circuit 200 generates a pulse as the TS timing signal upon the occurrence of data of a predetermined logic state as sensed by the sensors 100 and encoded by the encoding circuitry 101. In the illustrated and preferred embodiment, the encoding circuitry 101 encodes the data from the sensors 100 into binary and the transition start circuit 200 detects whenever a logic 1 signal has been encoded by the encoding circuit 101 and generates the TS timing signal accordingly.

The transistion start circuit 200 is suitably described in the above-referenced Sexton et al. patent, U.S. Pat. No. 3,820,063, which previously has been incorporated by reference.

Although a preferred embodiment of the invention has been described in a substantial amount of detail, it is understood that the specificity has been for example only. Numerous changes and modifications to the circuits and apparatus will be apparent without departing from the spirit and scope of the invention.

What is claimed is:

1. In a measuring-while-drilling system including a motor driven acoustic generator for imparting to well fluid an acoustic signal having an intermittently constant frequency, and having drive means controlled for momentarily changing the speed of the motor to effect a desired change in the phase state of the signal thereby to provide modulated data states to the signal, the improved control circuit for the drive means comprising:

(a) first means for changing the speed of the motor in a first direction;

(b) means, including at least one digital accumulator coupled to receive a motor frequency signal indicative of the instantaneous speed of the motor, for generating a pair of digital signals in response to speed changes in said first directions, the difference between said digital signals being indicative of the change in phase of the acoustic signal caused by the changing of the motor speed; and, (c) means for disabling said first means and thereby stopping said motor speed change in the first direction when the difference between said digital signals reaches a predetermined value indicative of a predetermined phase shift which is less than the desired change in phase.

2. The control circuit according to claim 1 wherein:

(a) said first means effects deceleration of the motor to a first relatively low value; and, (b) said control circuit further includes means for accelerating the speed of the motor to thereby return said speed from the relatively low value to said constant speed.

3. In a measuring-while-drilling system including an acoustic generator having a movable member driven at speeds for imparting to well fluid an acoustic signal having phase states representative of data derived from measured downhole conditions, and further including means for driving the movable member at a substantially constant rate to effect a substantially constant carrier frequency in the acoustic signal and for temporarily changing the rate of the member to effect a predetermined phase change in the acoustic signal according to the data, the improvement wherein the driving means includes a digital control circuit for temporarily changing the rate of movement of the member from the substantially constant rate and then, upon generation of a control signal, for returning the rate to the substantially constant rate comprising:

(a) a first digital accumulator circuit for providing a first digital signal having a value indicative of the value of the carrier frequency integrated over a time period beginning substantially upon the beginning of the rate change from the substantially constant rate, (b) a second digital accumulator circuit for providing a second digital signal during the phase changing having a value indicative of the value of the instantaneous rate of the member integrated over said time period, and (c) circuit means responsive to the first and second digital signals for generating said control signal to thereby effect said return rate change in the movement of the member when the difference between said first and second digital signals reaches a predetermined value.

4. The measuring-while-drilling system according to claim 3, wherein the first and second digitizing circuits respectively comprise digital counters for generating the digital signals.

5. The measuring-while-drilling system according to claim 3 the drive means includes a motor and the rate of movement of the member is changed in a first direction until a prescribed amount of said pre-determined phase change is achieved, wherein the rate of movement is changed in the opposite direction until the remainder of said pre-determined phase change is achieved, and wherein at least one of the digital accumulator circuits includes a programmable counter having programming inputs coupled to set the state of the programmable counter to a value corresponding to said prescribed amount of said predetermined phase change.

6. The measuring-while-drilling system according to claim 5 wherein said control signal generating circuit means includes a digital comparator responsive to said first and second digital signals.

7. The measuring-while-drilling system according to claim 5 wherein the driving means includes an acoustic generator drive motor whose speed is initially decelerated to a speed less than that corresponding to said constant speed and wherein said control circuit further includes a ramp signal generating circuit for generating a ramp signal in response to said control signal for effecting excitation of said motor as an increasing function with time, thereby to accelerate the speed of said motor from a less speed to accumulate said remainder of the predetermined phase change.

8. A well measuring-while-drilling system for measuring downhole conditions and imparting modulated acoustic signal representative thereof to drilling fluid within the well and which includes measuring apparatus adapted to be connected to a drill string and disposed in the well, the measuring apparatus including one or more sensors for sensing the downhole conditions and generating encoded sensor signals representative thereof, and including an acoustic generator responsive to the sensor signals for imparting to the drilling fluid an acoustic signal representative of one or more of the downhole conditions; wherein said acoustic generator comprises:

(a) a transmitter having a movable member disposed for selectively interrupting the downward passage of the drilling fluid to thereby generate the modulated acoustic signal, (b) a motor for movably driving said member, (c) a control circuit coupled to the sensor and to the motor for controlling energization thereof in response to the sensor signals, thereby to effect periodic interruption of the drilling fluid by the movable member, the control circuit including a phase and frequency maintaining circuit operative to drive the motor at a substantially constant speed in the absence of a sensor signal of a predetermined value to thereby provide the acoustic signal to have a substantially constant carrier frequency and a first phase value, and a modulation control circuit operative in response to said predetermined value of said sensor signal to momentarily change the speed of the motor away from said constant speed until the generation of a control signal and then back towards said constant speed to thereby provide the acoustic signal to have a second phase value relative to said first value, said modulation control circuit including a carrier frequency signal representative of the carrier frequency, second circuit means for digitally intergrating a motor frequency signal representative of the substantially instantaneous speed of the member, and third circuit means for generating said control signal when the difference between the values of the digitally integrated carrier and motor frequency signals reaches a predetermined value, thereby representative of the difference between said frist and second phase values reaching a predetermined value during said momentary change in frequency.

9. The measuring-while-drilling system according to claim 8

(a) wherein a tachometer is coupled to the motor for generating the motor frequency signal, (b) wherein said modulation control circuit includes a signal generator for generating the carrier frequency signal, and, (c) wherein said first circuit means includes a motor reference digital accumulator circuit responsive to the carrier frequency signal for providing a first accumulator signal having a value representative of the integral of the carrier frequency signal over a period beginning substantially upon the occurrence of said predetermined value of said sensor signal, (d) wherein said second circuit means includes a motor frequency digital accumulator circuit responsive to the motor frequency signal for providing a second accumulator signal having a value representative of the integral of the motor frequency signal over a period of time beginning substantially upon the occurrence of said predetermined value of said sensor signal, and (e) wherein the third circuit means further comprises a comparator circuit for indicating when the difference between the values of the first and second accumulator signals reaches said predetermined value.

10. The measuring-while-drilling system according to claim 8 wherein at least one of the digital accumulator circuits includes a presettable counter having a set of control terminals for establishing a preset count state thereof.

11. The measuring-while-drilling system according to claim 8 wherein the modulation control circuit includes (a) means for changing the speed of the motor from the constant speed to a lower interim speed in response to the sensor signal, and (b) means responsive to the control signal for restoring the speed of the motor to the constant speed upon the occurrence of said predetermined difference value.

12. The measuring-while-drilling system according to claim 8 wherein the control circuit is operative to initially decelerate said motor and it further includes a ramp signal generator circuit responsive to said control signal for generating a ramp signal for effecting excitation of the motor as an increasing function with time, thereby to accelerate the speed of the motor to provide the acoustic signal to have said second phase value.

13. A well measuring-while-drilling system for measuring downhole conditions and transmitting a modulated acoustic signal representative thereof through drilling fluid within the well and including measuring apparatus adapted to be coupled to a drill string in the well, the measuring apparatus including one or more sensors for sensing the downhole conditions and generating encoded sensor signals representative thereof, and an acoustic generator responsive to the sensor signals for imparting to the drilling fluid an acoustic signal representative of one or more of the downhole conditions; the improved acoustic generator comprising:

(a) a rotary valve transmitter having a rotor disposed for selectively interrupting the downward passge of the drilling fluid to thereby generate the modulated acoustic signal;

(b) a tachometer-equipped motor for rotating said rotor;

(c) a control circuit coupled to the sensor and to the motor for controlling operation of the motor in response to the sensor signals, thereby to effect periodic interruption of the drilling fluid by the rotor, the control circuit including a phase and frequency maintaining circuit operative to drive the motor at a substantially constant speed to thereby effect the acoustic signals to have a constant carrier frequency and a reference phase in the absence of a sensor signal of a predetermined value, and a modulation control circuit operative in response to said predetermined value of said sensor signal to momentarily change the frequency of the motor to thereby provide the acoustic signal to have a changed phase value relative to said reference phase, said modulation control circuit including digitizing circuit means for digitizing a carrier frequency signal representative of the carrier frequency, for digitizing a motor frequency signal generated by the tachometer representative of the substantially instantaneous frequency of the motor and for generating a control signal when the difference between integrated values of the digitized carrier and motor frequency signals reach a predetermined value, thereby representative of the difference between said first and second phase values reaching a predetermined value during said momentary change in frequency, wherein said digitizing circuit means comprises a motor reference counter responsive to the carrier frequency signal for providing a first counter signal having a value representative of the integral of the carrier frequency signal over a period beginning substantially upon the occurrence of said predetermined value of said sensor signal, a motor frequency counter responsive to the motor frequency signal for providing a second counter signal having a value representative of the integral of the motor frequency signal over a period of time beginning substantially upon the occurrence of said predetermined value of said sensor signal, and a comparator circuit for indicating when the difference between the values of the first and second counter signals reaches said predetermined value, wherein further at least one of said counters is presettable to a reference state.

14. The measuring-while-drilling system according to claim 13 wherein the modulation control circuit changes the drive frequency of the motor from the carrier frequency to a lower interim frequency in response to the sensor signal and restores the frequency of the motor to the carrier frequency upon the occurrence of said predetermined difference value and wherein the modulation control circuit further includes a ramp signal generator circuit responsive to said control signal for generating a ramp signal for effecting excitation of the motor as an increasing function with time, thereby to accelerate the speed of said motor to provide the acoustic signal to have said changed phase value.

15. In a measuring-while-drilling system which includes a motor for driving an acoustic generator at predetermined speeds for imparting to well fluid an acoustic signal having phase states representative of encoded data derived from measured downhole conditions, which further includes a motor speed control circuit for driving the motor at a first substantially constant speed to effect a carrier frequency for the acoustic signal and which momentarily changes the speed of the motor to thereby change the phase of the acoustic signal upon the occurrence of data, a method comprising of the steps of:

(a) generating a signal representative of the carrier frequency;

(b) generating a signal representative of the substantially instantaneous speed of the acoustic generator;

(c) changing the speed of the motor from the constant speed;

(d) digitally integrating the carrier frequency signal and the instantaneous speed signal over a time period beginning substantially upon the occurrence of said data;

(e) generating a control signal when the difference between said digitally integrated signal reaches a predetermined value; and (f) changing the speed of the motor back to the constant speed in response to the control signal.

16. The method according to claim 15 wherein the step of digitally integrating includes the step of presetting to a predetermined value a programmable counter responsive to one of either of the carrier or instantaneous speed signals.

17. The method according to claim 15 and further including the steps of:

(a) reducing the speed of the motor to a predetermined value and maintaining the speed thereat until said step of generating a control signal has occurred; and, (b) thereafter accelerating the speed of the motor towards said substantially constant speed.

18. The method according to claim 17 wherein said step of accelerating is at a changing rate of acceleration.

19. In a measuring-while drilling system including a motor driven acoustic generator for imparting to well fluid an acoustic signal having an intermittently constant frequency, the method of momentarily changing the speed of the motor to effect a desired amount of change in the phase state of the signal thereby to provide encoded data states to the signal, comprising the steps of:

(a) changing the speed of the motor in a first direction;

(b) in response to the step of changing, digitally integrating the instantaneous motor speed and the constant frequency motor speed, to thereby generate a pair of digital signals, the difference between said digital signals being indicative of the change in phase of the acoustic signal caused by the changing of the motor speed; and (c) stopping said motor speed change in the first direction when the difference between said digital signals reaches a predetermined value indicative of a predetermined phase shift which is less than the desired change in phase.

20. The method according to claim 19 wherein:

(a) the step of changing the speed of the motor includes the step of initially decelerating the speed of the motor to a first relatively low value; and, (b) said method includes the step of accelerating the speed of the motor by exciting said motor as a changing-with-time function to thereby return said speed to said constant speed.

21. The method according to claim 20 and further including the step of sensing downhole conditions and generating data in binary format and wherein the step of changing the speed of the motor is performed only upon the generation of data of a particular logic state.

22. The method according to claim 19 and includng the step of detecting when the difference between said digital signals reaches the predetermined value.

* * * * *